US008508140B2

(12) United States Patent
Leung et al.

(10) Patent No.: US 8,508,140 B2
(45) Date of Patent: Aug. 13, 2013

(54) LED SWITCH CIRCUITRY FOR VARYING INPUT VOLTAGE SOURCE

(75) Inventors: Wa-Hing Leung, Hong Kong (CN); Johnny Siu, Hong Kong (CN)

(73) Assignee: Huizhou Light Engine Ltd., Huizhou (CN)

( * ) Notice: Subject to any disclaimer, the term of this patent is extended or adjusted under 35 U.S.C. 154(b) by 284 days.

(21) Appl. No.: 12/955,030

(22) Filed: Nov. 29, 2010

(65) Prior Publication Data

US 2012/0038285 A1 Feb. 16, 2012

Related U.S. Application Data

(60) Provisional application No. 61/373,058, filed on Aug. 12, 2010.

(51) Int. Cl.
*H05B 37/00* (2006.01)
*H05B 41/00* (2006.01)

(52) U.S. Cl.
USPC ..... 315/192; 315/191

(58) Field of Classification Search
USPC ..... 315/122, 185 R, 186, 191, 192, 224, 315/294, 306
See application file for complete search history.

(56) References Cited

U.S. PATENT DOCUMENTS

| | | | | |
|---|---|---|---|---|
| 7,649,326 | B2 * | 1/2010 | Johnson et al. | 315/291 |
| 7,688,002 | B2 * | 3/2010 | Ashdown et al. | 315/291 |
| 7,710,050 | B2 * | 5/2010 | Preston et al. | 315/312 |
| 2003/0164809 | A1 * | 9/2003 | Leung | 345/46 |
| 2004/0233145 | A1 * | 11/2004 | Chiang | 345/82 |
| 2010/0194289 | A1 * | 8/2010 | Katayanagi et al. | 315/151 |
| 2010/0207150 | A1 | 8/2010 | Grajcar | |
| 2011/0025216 | A1 * | 2/2011 | Ching-Chi et al. | 315/186 |

FOREIGN PATENT DOCUMENTS

| | | | |
|---|---|---|---|
| CN | 101137261 | A | 3/2008 |
| CN | 101431845 | A | 5/2009 |
| CN | 101646283 | A | 2/2010 |
| KR | 100942234 | B1 | 2/2010 |

OTHER PUBLICATIONS

PCT Notification of Transmittal of the International Search Report and the Written Opinion of the International Searching Authority, or the Declaration, dated May 19, 2011 in connection with PCT International Application No. PCT/CN2010/078683.
U.S. Appl. No. 61/234,094, Zdenko Grajcar.
U.S. Appl. No. 61/233,829, Zdenko Grajcar.
U.S. Appl. No. 61/255,491, Zdenko Grajcar.
"Performance Differences in AC LED Technology" by Once Innovations, Inc. dated May 18, 2010.

* cited by examiner

*Primary Examiner* — Minh D A
(74) *Attorney, Agent, or Firm* — Schiff Hardin LLP

(57) ABSTRACT

An LED array switching apparatus, comprises: a plurality of LED segments D1 to Dn connected in series, each LED segment having a forward voltage; a voltage supply coupled to the plurality of LED segments; and a plurality of constant current sources G1 to Gn, coupled to outputs of LED segments D1 to Dn, respectively. Each of the constant current sources is switchable between a current regulating state and an open state such that as the voltage of the voltage supply increases, LED segments are switched on and lit to form a higher forward voltage LED string, and as the voltage of the voltage supply decreases, segments are switched off and removed from the LED string starting with the most recently lit segment.

11 Claims, 19 Drawing Sheets

LED SWITCH CIRCUITRY FOR VARYING INPUT VOLTAGE SOURCE

CROSS-REFERENCE TO RELATED APPLICATIONS

This application claims benefit of U.S. Provisional Patent Application No. 61/373,058, filed Aug. 12, 2010, the entirety of which is incorporated by reference herein.

BACKGROUND OF THE INVENTION

The present invention relates to switching circuitry used in driving LED light sources. In particular, circuitry in which LEDs are driven by a regulated current source.

Conventionally, LEDs may be driven by a current source that regulates the current flowing through the LEDs and hence maintains the light output of the LEDs. FIG. 1 shows a typical circuit for driving an LED circuit in which V is an input voltage source, D is representative of a string of LEDs and G is a current source. In such a circuit, in order for current to flow through D, the source input voltage of V must be higher than the forward voltage of the LEDs D.

However, if voltage of input voltage source V is much higher than the forward voltage of D, a large voltage drop is present in current source G. Such an occurrence may cause a significant power loss in current source G, particularly if current source G is a linear current source.

BRIEF SUMMARY OF THE INVENTION

In accordance with a first aspect of the present invention, an LED array switching apparatus, comprises: a plurality of LED segments D1 to Dn connected in series, each LED segment having a forward voltage; a voltage supply coupled to the plurality of LED segments; and a plurality of constant current sources G1 to Gn, coupled to outputs of LED segments D1 to Dn, respectively, each of the constant current sources being switchable between a current regulating state and an open state such that as the voltage of the voltage supply increases, LED segments are switched on and lit to form a higher forward voltage LED string, and as the voltage of the voltage supply decreases, segments are switched off and removed from the LED string starting with the most recently lit segment.

In another aspect, the LED array switching apparatus further comprises: a toggle switcher that has an output that toggles between a first output and a second output complementary to the first output; a first switch coupled to the first output of the toggle switcher; a second switch coupled to the second output of the toggle switcher and to the plurality of constant current sources; and a plurality of second constant current sources GT1 to GTn coupled to outputs of LED segments Dn to D1, respectively, and to the first switch, wherein when the first output of the toggle switcher is active, the first switch becomes closed and the second constant current sources are disabled and the constant current sources are active, and when the second output of the toggle switcher is active, the second switch is closed and the constant current sources are disabled and the second constant current sources are active.

In another aspect, when the second output of the toggle switcher is active, the LED segments are switched on and lit in an opposite order from when the first output of the toggle switcher is active.

In another aspect, the toggle switcher toggles at a frequency of greater than 20 Hz.

In another aspect, successive ones of the plurality of constant current sources are switched on and off such that only one of the plurality of constant current sources supplies current to the LED segments forming the LED string at any given time.

In another aspect, each of the plurality of constant current sources includes circuitry that detects a current flowing through the LED string and enables or disables that constant current source based on the detected current.

In another aspect, the voltage supplied by the voltage supply is a rectified AC voltage signal.

In another aspect, the voltage supply includes a triac dimmer having an RC timing circuit, and the LED array switching circuit further comprises: a bleeder circuit coupled to the voltage supply and the constant current sources, the bleeder circuit including a bypass resistor, the bleeder circuit being operable to connect the bypass resistor across the input voltage, to allow sufficient charging current to be supplied to the RC timing circuit, when the rectified input voltage is low enough to indicate that the triac is off, and to disconnect the bypass resistor when the input voltage is high enough to indicate that the triac is on.

In accordance with another aspect of the present invention, there is provided a method of driving an LED array that includes a plurality of LED segments D1 to Dn connected in series, each LED segment having a forward voltage, a voltage supply coupled to the plurality of LED segments, and a plurality of constant current sources G1 to Gn, coupled to outputs of LED segments D1 to Dn, respectively. The method comprises: (a) when the voltage of the voltage supply is increasing: switching on successive ones of the constant current sources, so as to form a higher forward voltage LED string of the LED segments and disabling others of the constant current sources, such that only one of the plurality of constant current sources supplies current to the LED segments forming the LED string at any given time; and (b) when the voltage of the voltage supply is decreasing, switching on successive ones of the constant current sources, in reverse order from the switching on performed in step (a), so as to form a lower forward voltage string of the LED segments and disabling others of the constant current sources, such that only one of the plurality of constant current sources supplies current to the LED segments forming the LED string at any given time.

In another aspect, when the voltage supply is increasing, the LED segments are successively added to the string of the LED segments.

In another aspect, when the voltage supply is decreasing, the LED segments are successively removed from the string of the LED segments.

In another aspect, circuitry in the plurality of constant current sources senses current flowing through LED segments and the switching on and disabling of respective ones of the constant current sources is performed on the basis of the sensed current.

BRIEF DESCRIPTION OF THE DRAWINGS

The figures are for illustration purposes only and are not necessarily drawn to scale. The invention itself, however, may best be understood by reference to the detailed description which follows when taken in conjunction with the accompanying drawings in which.

DETAILED DESCRIPTION OF THE INVENTION

FIGS. 2-14 illustrate aspects of preferred embodiments of LED array switching apparatus. For an LED lighting device to work using a varying input voltage source, such as a rectified AC source, the switching apparatus in accordance with the present invention divides the LED string into a series of multiple segments. When the input voltage is low, only the first LED segment is lit up. As the input voltage increases, subsequent LED segments are switched in series to form a higher forward voltage string. Contrarily, if the input voltage decreases, the sequence is reversed and segments are removed from the string starting with the last light-up segment.

Figure 2:
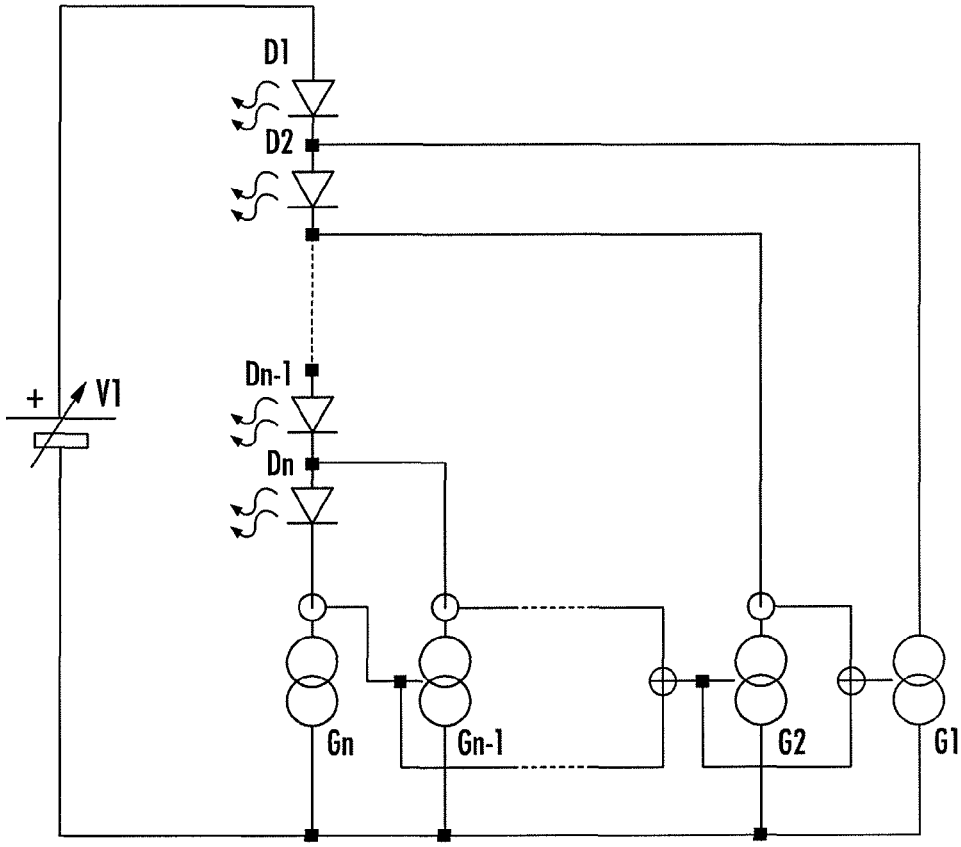
FIG. 2 is functional block diagram of a circuit for LED array switching in accordance with an embodiment of the present invention.

FIG. 2 shows the functional blocks of the proposed circuitry. It is assumed that the LED string is divided into n LED segments D1 to Dn, where n>1. Each LED segment may consist of one or more LEDs. G1 to Gn are constant current sources which can be disabled, that is, changed to an open circuit condition, by current sense signals from successive current sources.

Figure 3A:
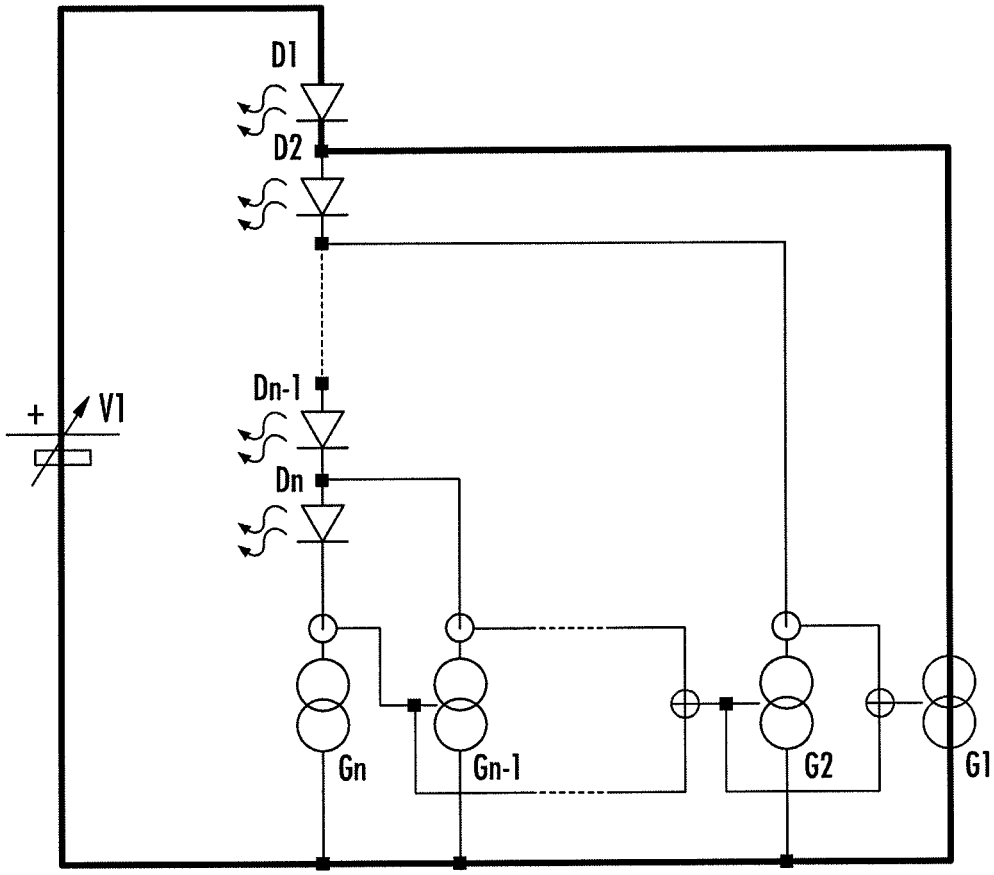
FIGS. 3A-3F are diagrams illustrating current paths taken through the circuit of FIG. 2 at different voltages levels of the source voltage, in accordance with an embodiment of the present invention.
Figure 3B:
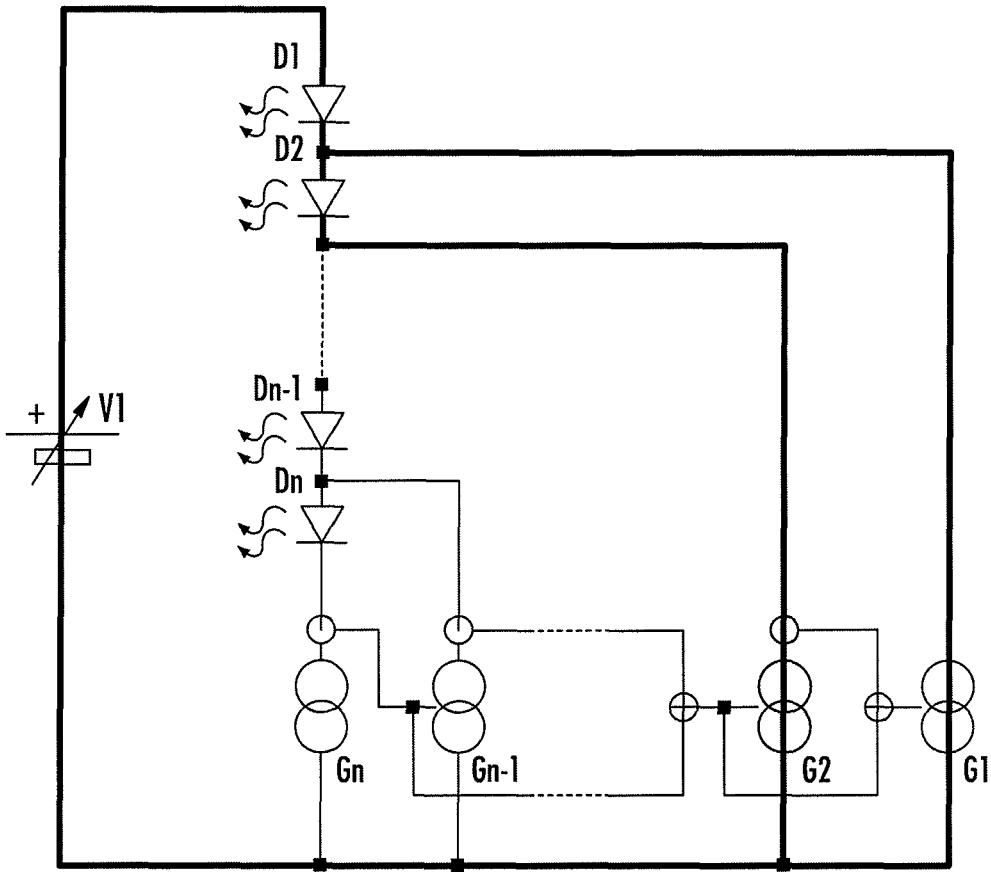
Figure 3C:
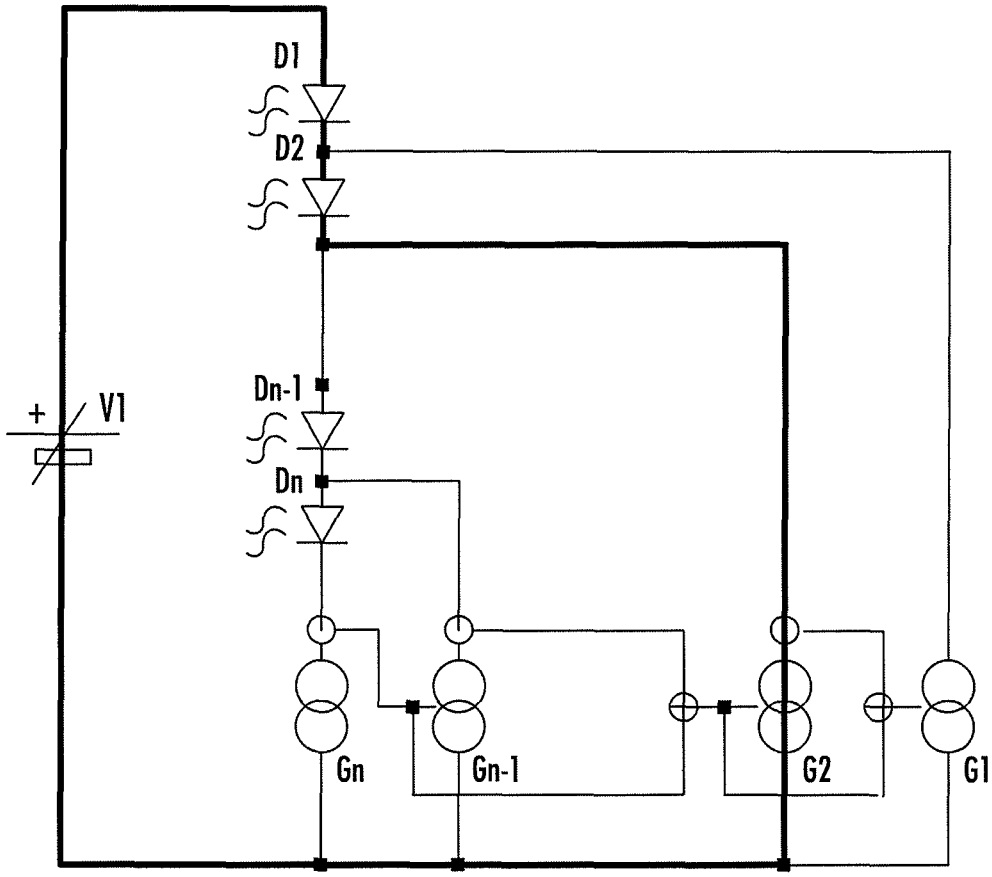

The operation of the circuit of FIG. 2 is next described making reference to FIGS. 3A-3F, for the case in which the voltage of V1 is ramping up from zero. When the voltage of V1 is just above the forward voltage of LED segment D1, current begins to flow through LED segment D1 and current source G1, as shown in FIG. 3A. Current source G1 regulates the current through LED segment D1 as voltage of V1 is further increased. LED segment D2 begins to conduct when V1 reaches the sum of the forward voltages of LED segment D1 and LED segment D2, as shown in FIG. 3B. As the current through LED segment D2 is increasing to a threshold value, which is preferably set lower than the regulating value of current source G2, current source G1 is disabled, becoming an open circuit. The current through LED segment D1 and LED segment D2 is then regulated by current source G2, as shown in FIG. 3C.

Figure 3D:
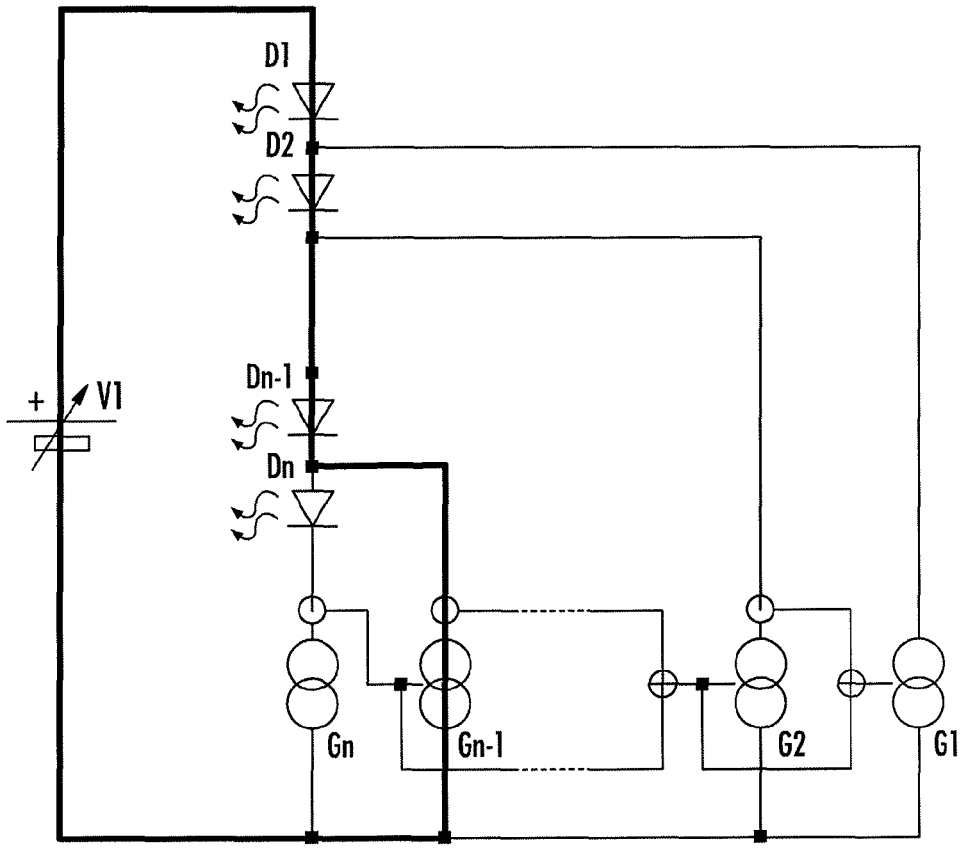
Figure 3E:
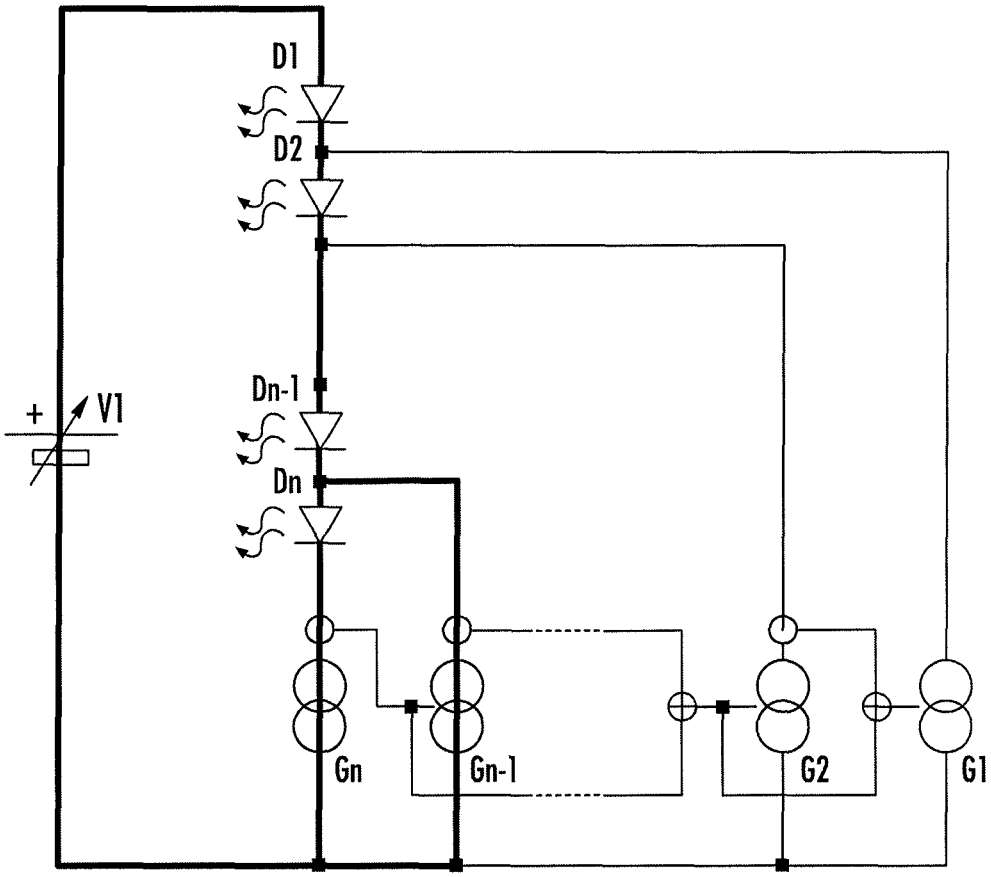
Figure 3F:
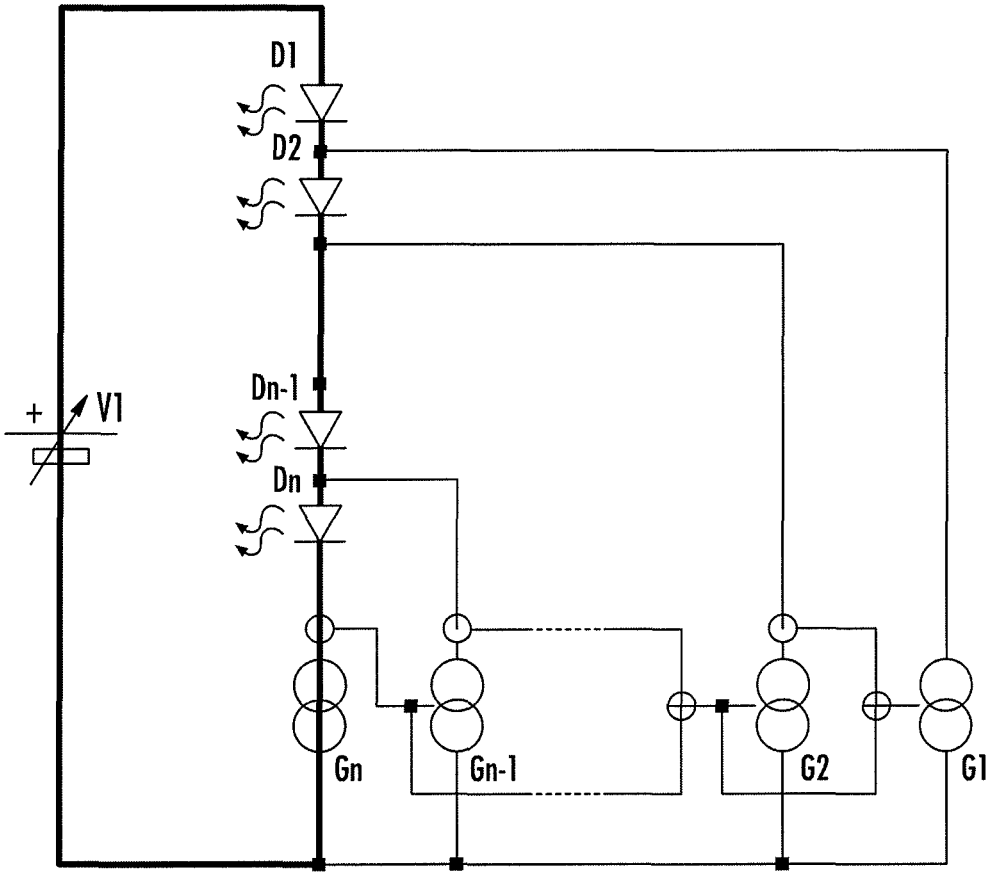

FIG. 3D shows the current path in the circuit when V1 has been increased to the point at which current source Gn−1 regulates the current through LED segments D1 to Dn−1. Further increasing V1 causes LED segment Dn to conduct, as shown in FIG. 3E. FIG. 3F shows the current path when the current through LED segment Dn is increased to trigger current sources G1 to Gn−1 to be in the open condition.

As would be understood by one of ordinary skill in the art, the switching sequence shown in FIGS. 3A-3F would be reversed if the voltage of V1 is declining. In particular, the situation in which the voltage of V1 is high enough to pass a regulated current through LED segments D1 to Dn and current source Gn is shown in FIG. 3F. As V1 is decreased, the current through Gn starts to decrease and to a point below the threshold value, current source Gn−1 is enabled and current begins to flow through current source Gn−1 as shown in FIG. 3E. When V1 decreases to a value below the sum of forward voltage sum of LED segments D1 to Dn, current through LED segment Dn is stopped, as shown in FIG. 3D.

Figure 4:
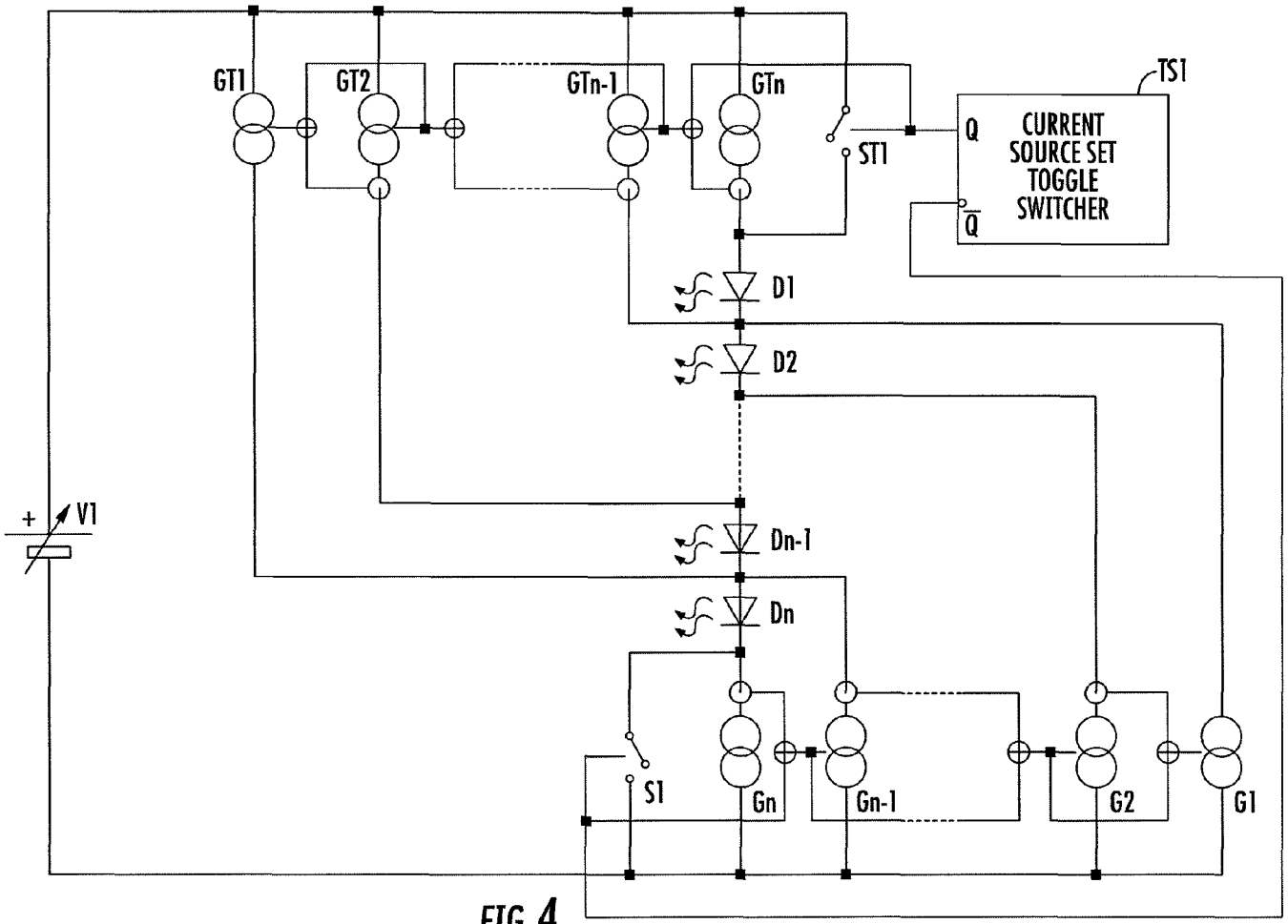
FIG. 4 is a functional block diagram of the circuit of FIG. 2 with an optional set of current sources for averaging of the usage among the LEDs, in accordance with an aspect of the present invention.

As can be seen from the foregoing description, in the circuit of FIG. 2, LED segment D1 conducts if any one of the constant current sources is conducting. On the other hand, LED segment Dn only conducts if current source Gn is conducting. Thus, in operation, LED segment D1 would be used more often than LED segment Dn. FIG. 4 is a block diagram of a circuit that averages the usage among LED segments D1 to Dn. The circuit includes a set of additional current sources GT1-GTn and a current source set toggle switcher TS1 added to the circuit of FIG. 2.

As can be seen in FIG. 4, the current source set toggle switcher TS1 has two complementary signal outputs Q and $\overline{Q}$. Preferably, the toggle switcher TS1 is configured such that these outputs are toggling at frequency above 20 Hz, to avoid the perception of flicker. When Q of the toggle switcher TS1 is active, the switch ST1 connected to this output becomes closed, current sources GT1 to GTn are disabled, and switch S1 is opened. In this condition, the circuit of FIG. 4 is essentially identical to the circuit shown in FIG. 2, and operates as described above upon occurrence of ramping up or down of input voltage V1.

Figure 1:
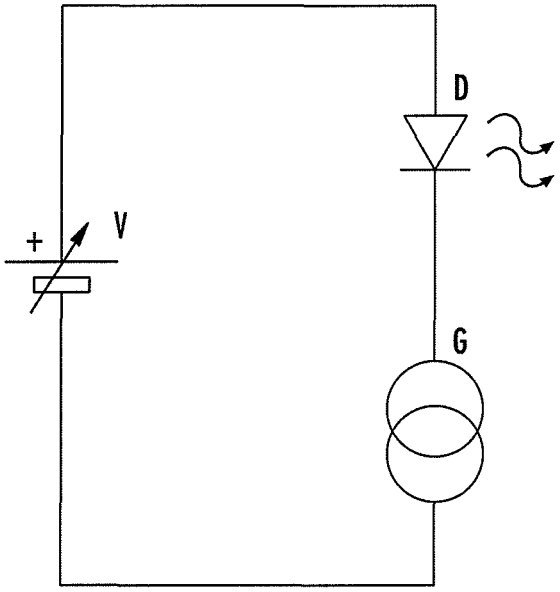
FIG. 1 PRIOR ART
FIG. 1 is a circuit diagram of a conventional LED driving circuit that utilizes a current source.

When $\overline{Q}$ becomes active, and Q becomes non-active, switch S1 becomes closed, current sources G1 to Gn are disabled, switch ST1 is opened, and current sources GT1 to GTn are operational. In this situation, if V1 is ramping up from zero voltage, unlike in the circuit of FIG. 1, Dn will be the first conducting segment followed by Dn−1, just the opposite of what occurs in the circuit of FIG. 2. Thus, over time, the usage of the LEDs will average out.

Figure 5:
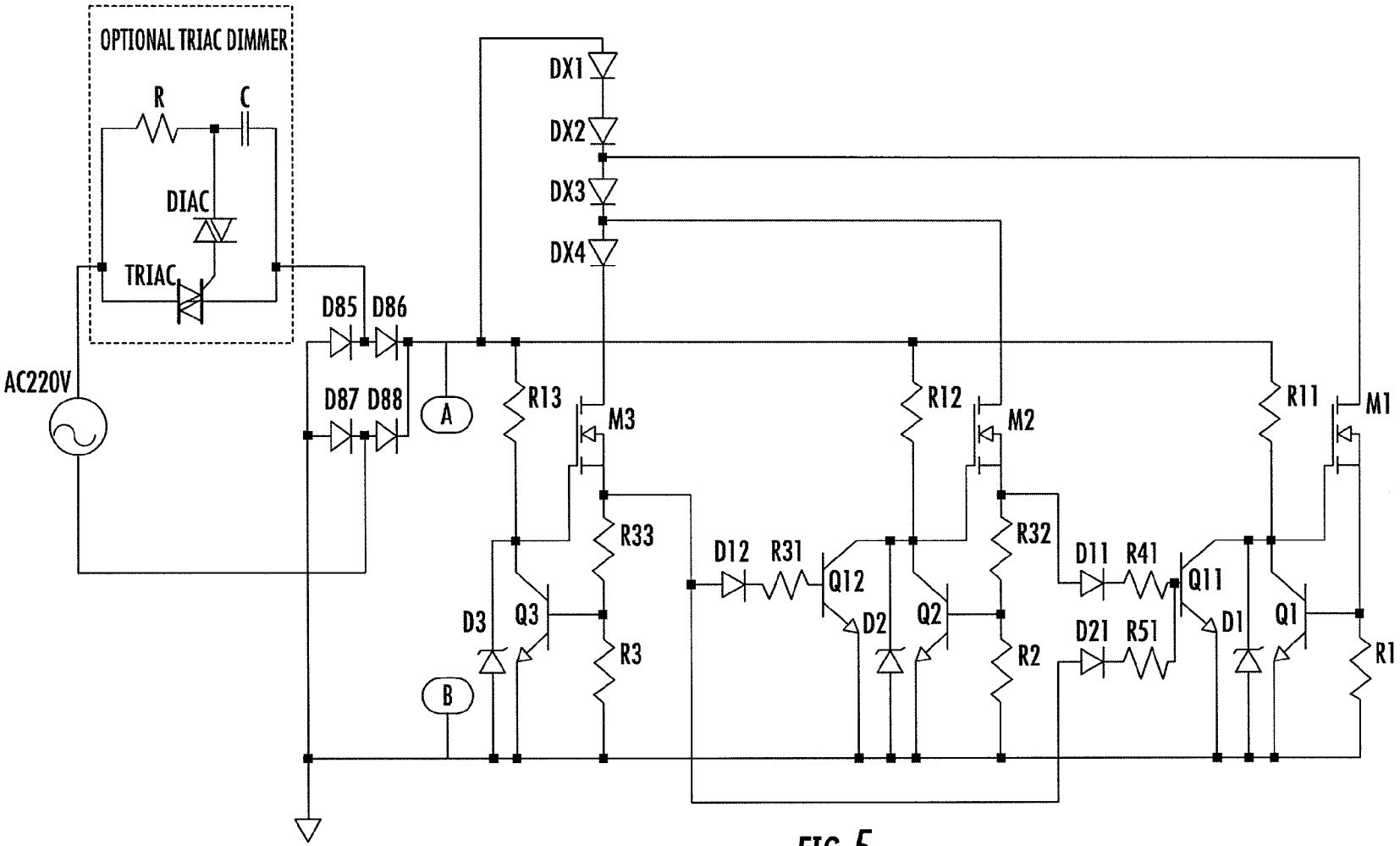
FIG. 5 is a circuit diagram showing a practical implementation of the circuit shown in FIG. 2.
Figure 6:
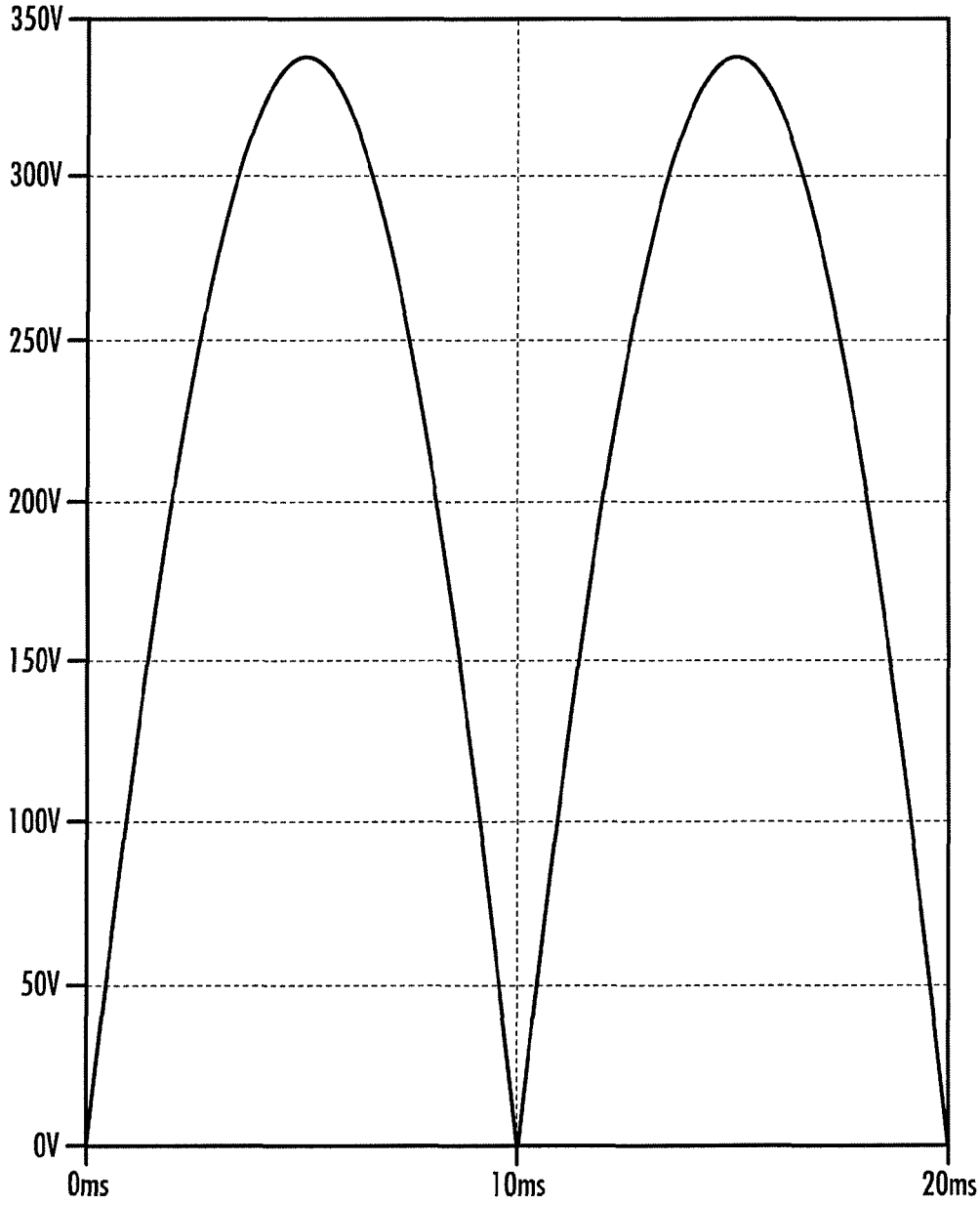
FIG. 6 is a diagram of the voltage waveform across nodes A and B in FIG. 5.

FIG. 5 shows a practical detailed implementation of the proposed circuit shown in FIG. 2 with n=3. In the figure, the AC 220V main voltage source is a rectified signal. The voltage waveform across node A and B is shown in FIG. 6. The LED string, consists of four LEDs DX1-DX4, with forward voltage of 50V each, and is divided into 3 segments. The first segment has 2 LEDs (DX1 and DX2) while the second and third segments, each have a single LED (DX3 and DX4, respectively).

As can be seen in the figure, transistor M1, resistors R1 and R11, transistor Q1 and diode D1 form a constant current source that drives LEDs DX1 and DX2. Transistor Q11 turns off transistor M1 when the current through transistor M2 reaches threshold value.

Figure 7:
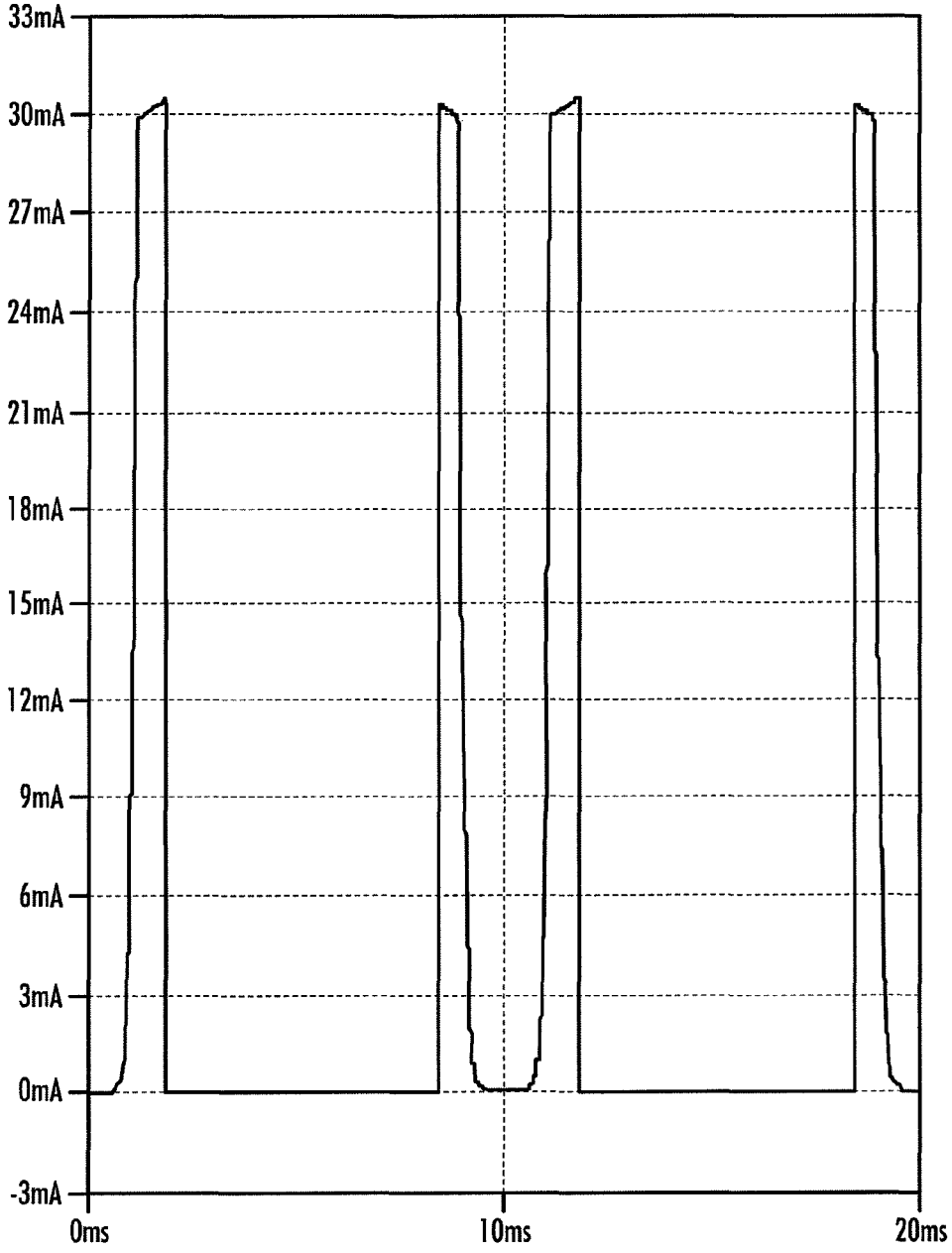
FIG. 7 is a diagram of the current through element M1 in FIG. 5.
Figure 8:
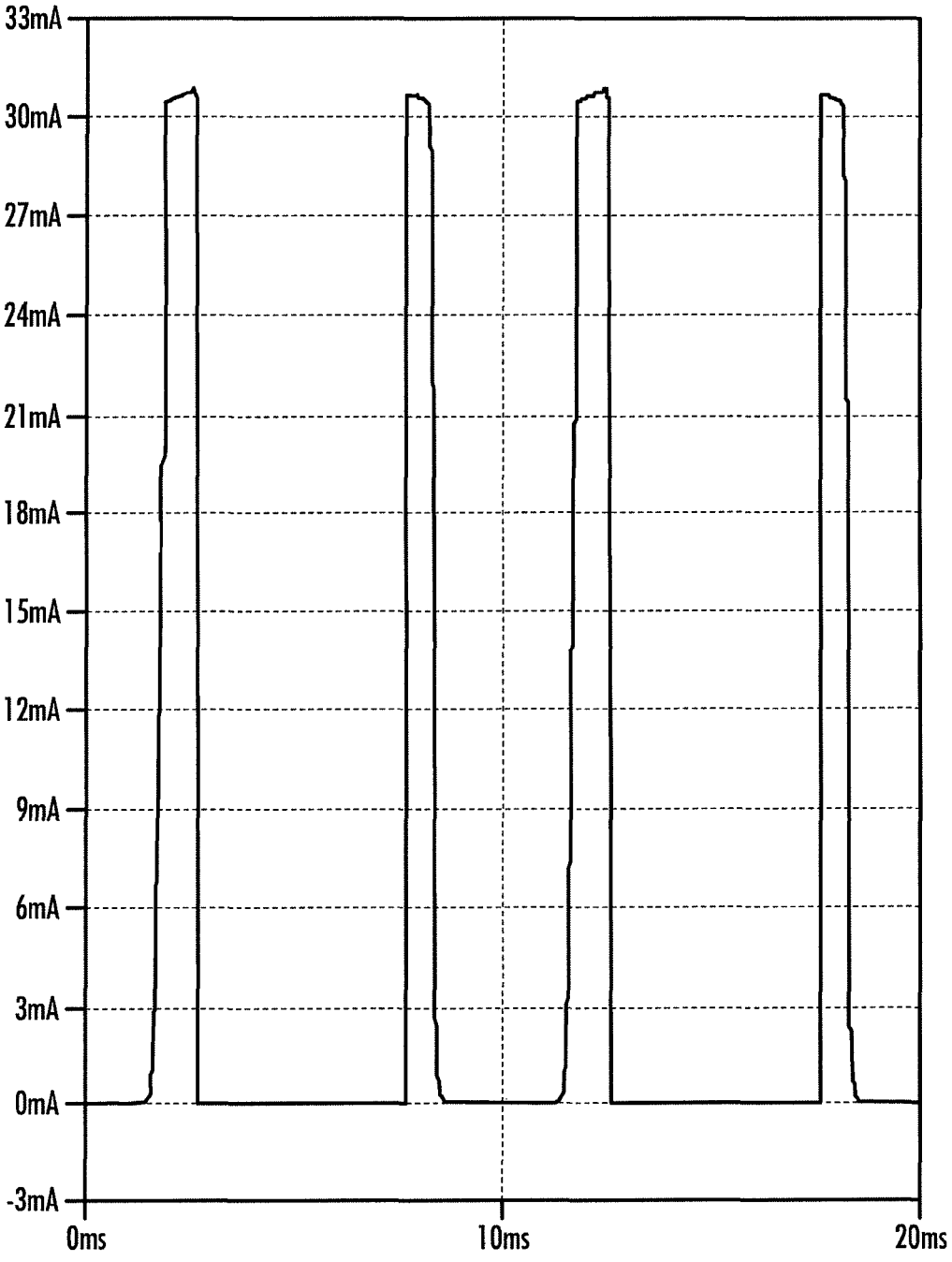
FIG. 8 is a diagram of the current through element M2 in FIG. 5.
Figure 9:
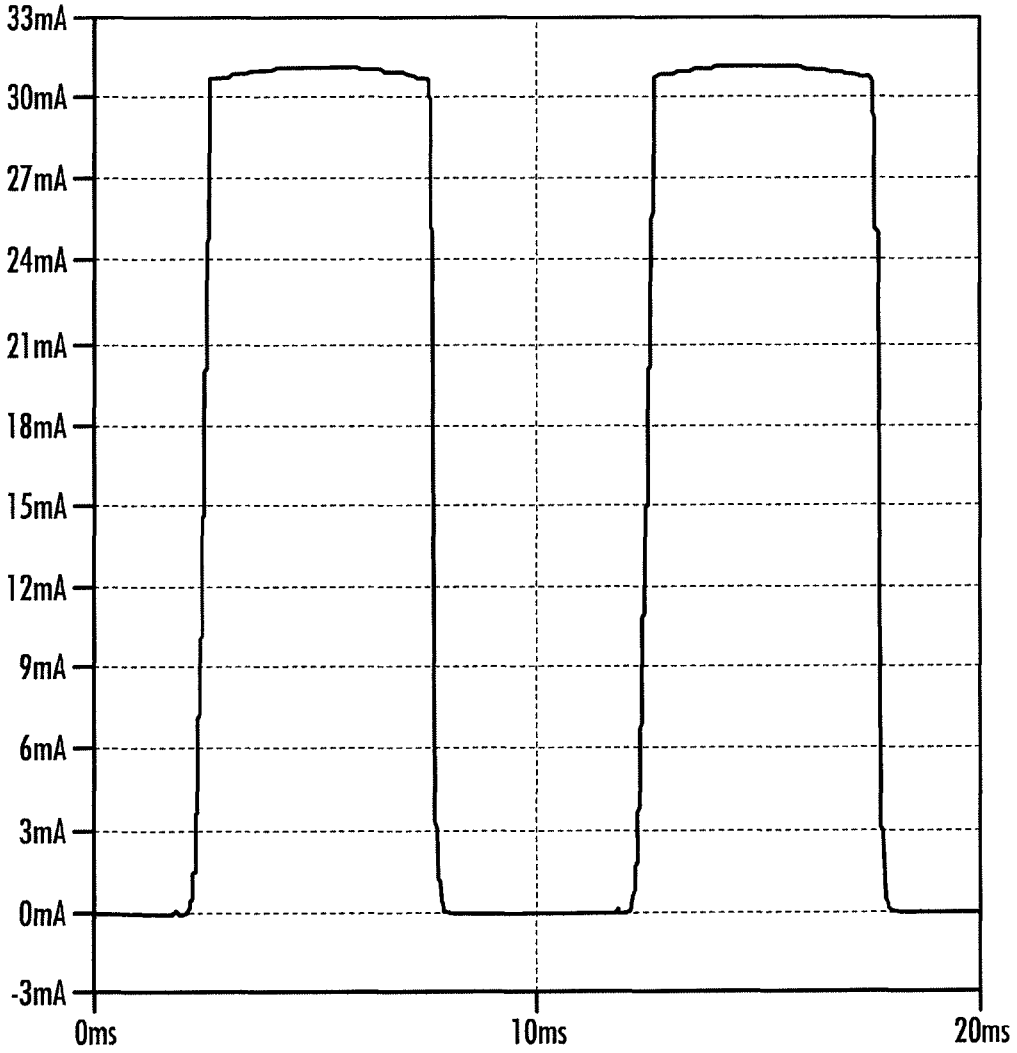
FIG. 9 is a diagram of the current through element M3 in FIG. 5.
Figure 10:
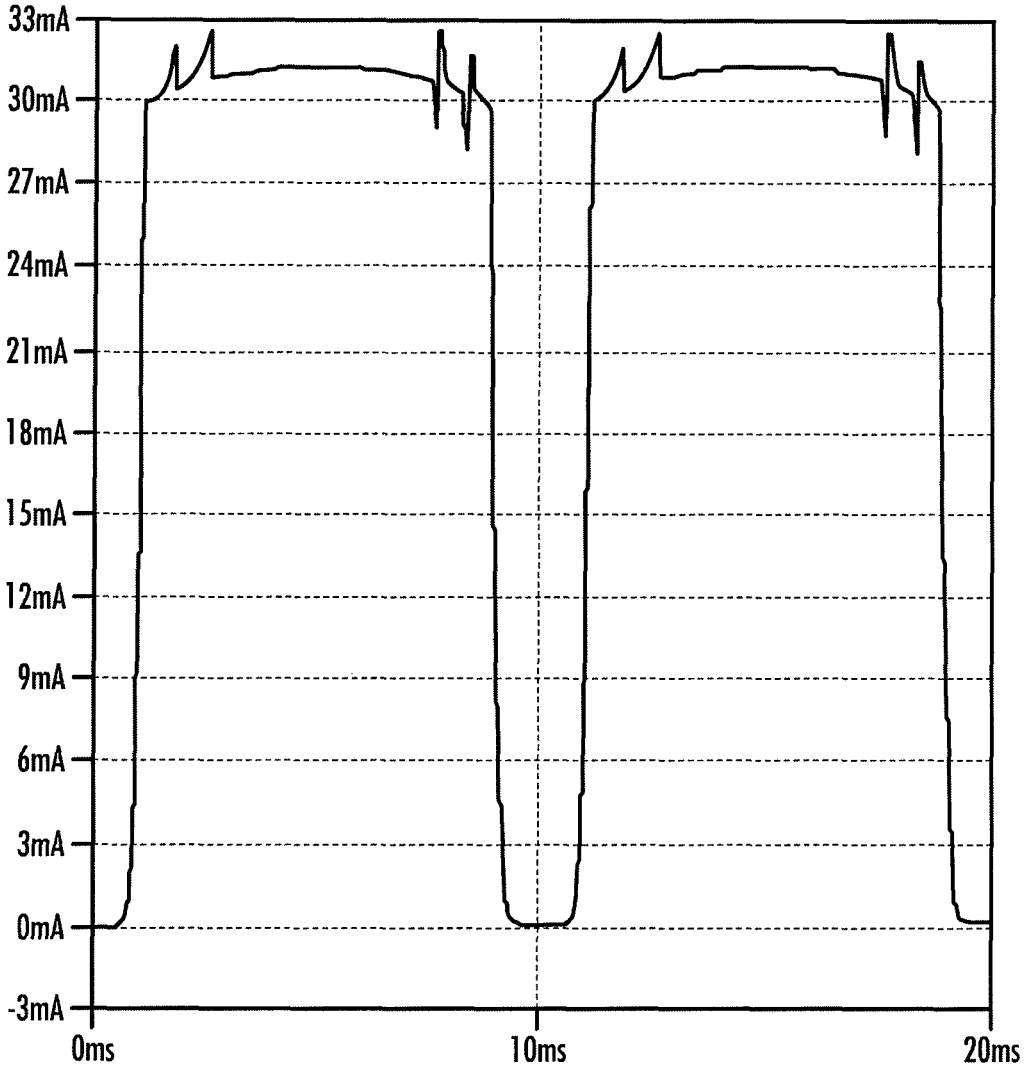
FIG. 10 is a diagram of the current through element DX1 in FIG. 5.
Figure 11:
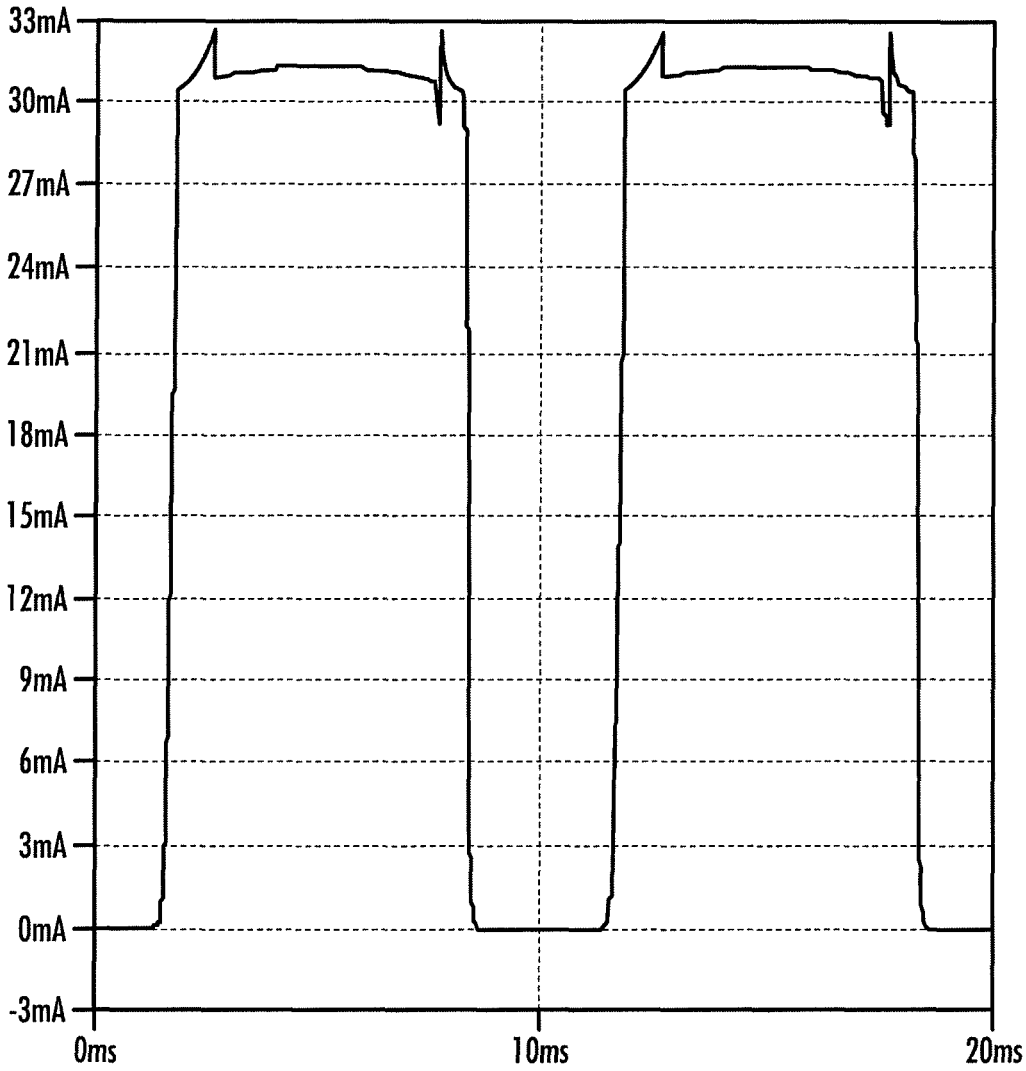
FIG. 11 is a diagram of the current through element DX3 in FIG. 5.
Figure 12:
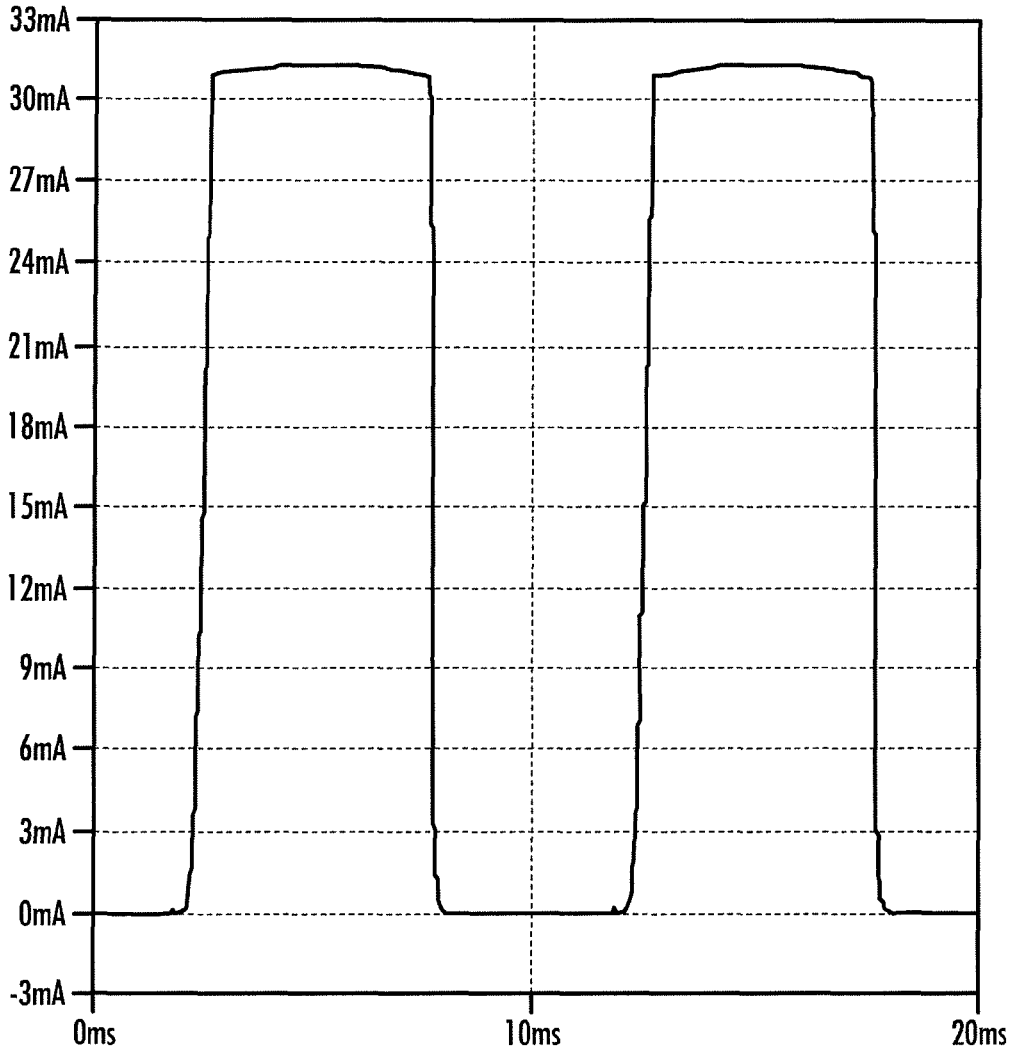
FIG. 12 is a diagram of the current through element DX4 in FIG. 5.

FIG. 7 shows the current waveform of transistor M1. Waveforms corresponding to the current in transistors M2 and M3 are shown in FIGS. 8 and 9, respectively. FIGS. 10, 11 and 12 show the current waveforms of LEDs DX1, DX3 and DX4 respectively. The current of LED DX1 is the current sum of transistors M1, M2 and M3, while the current of LED DX3 is the current sum of transistors M2 and M3.

Figure 13:
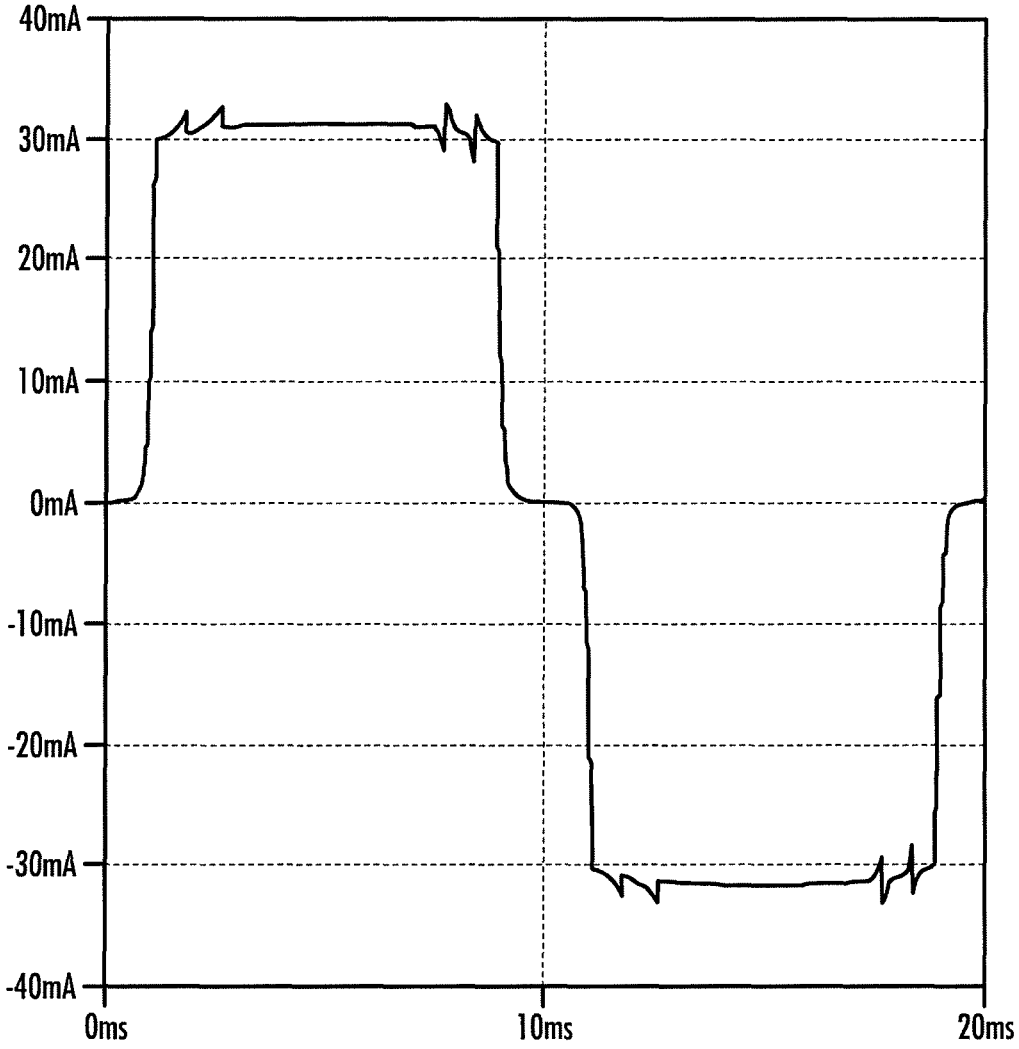
FIG. 13 is a diagram showing the input waveform at the AC main source in FIG. 5.
Figure 14:
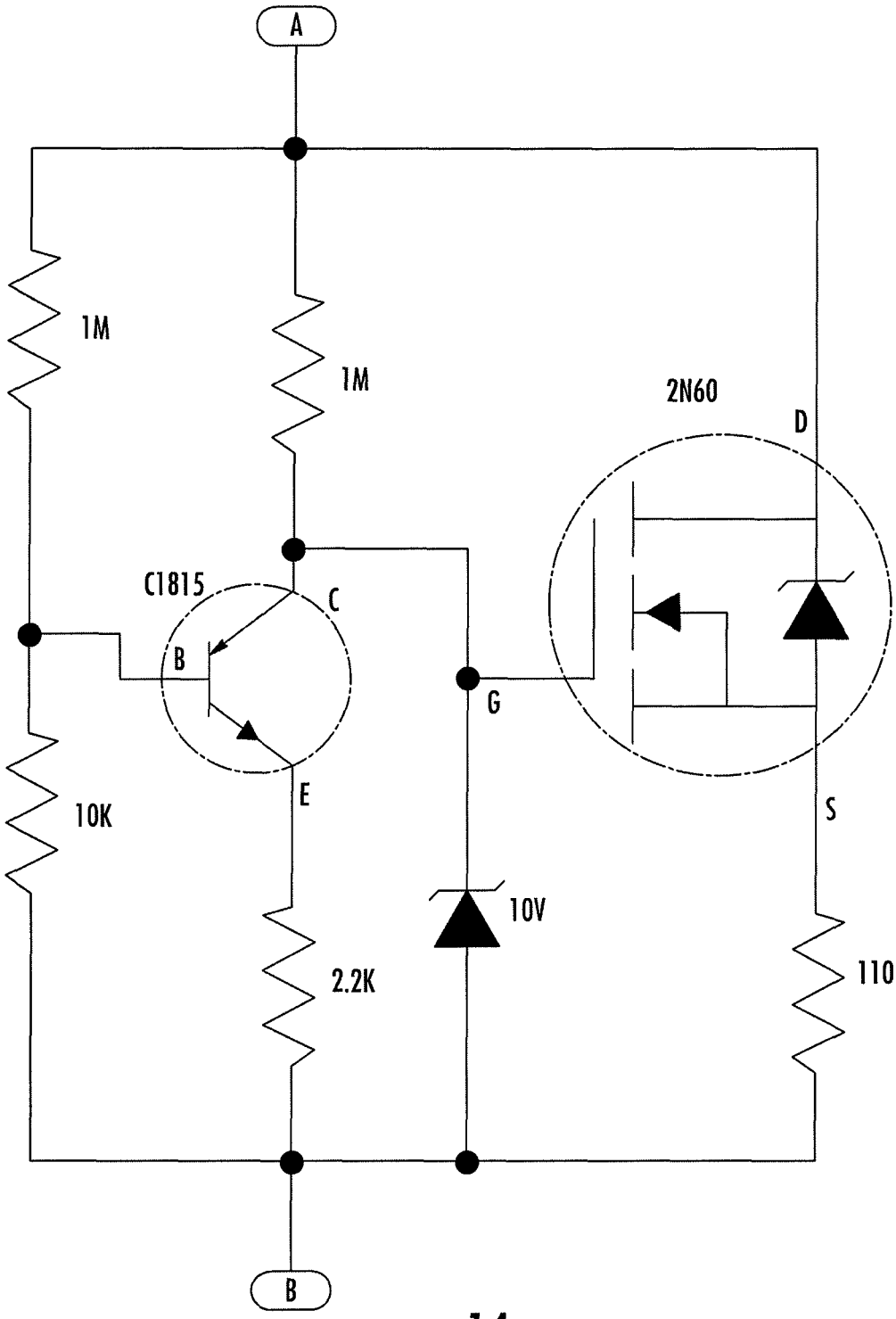
FIG. 14 is a circuit of a bleeder circuit that can be used with the circuit of FIG. 5.

FIG. 13 shows the input current waveform from AC main power source. Throughout most of the half line cycle, the current is continuous, which makes the circuit suitable to work with an optional triac dimmer, shown in FIG. 5. An optional bleeder circuit can be added to provide a current path for the triac dimmer's RC timing circuit when the triac is off. FIG. 14 shows a form of bleeder circuit which connects to node A and B of FIG. 5. The bleeder circuit acts like a resistive load for the dimmer when the triac is not conducting. A bypass resistor 110 is switched on by transistor 2N60 to connect across the rectified input voltage when the rectified input voltage is low (which indicates the triac is off). With the bypass resistor completing the circuit, sufficient charging current can be supplied to the internal RC timing circuit of the triac dimmer to ensure proper operation. When the rectified input voltage is high (which indicates the triac is on), the bypass resistor is disconnected by transistor 2N60 to minimize wasteful power dissipation.

Although specific embodiments have been illustrated and described herein, it will be appreciated by those of ordinary skill in the art that a variety of alternate and/or equivalent implementations may be substituted for the specific embodiments shown and described without departing from the scope of the present invention. This provisional application is intended to cover any adaptations or variations of the specific embodiments discussed herein. Therefore, it is intended that this invention be limited only by the claims and the equivalents thereof.

What is claimed is:

1. An LED array switching apparatus, comprising:

a plurality of LED segments (D1) to (Dn) connected in series, each LED segment having a forward voltage;

a voltage supply coupled to the plurality of LED segments; and a plurality of constant current sources (G1) to (Gn), coupled to outputs of LED segments (D1) to (Dn), respectively, each of the constant current sources being switchable between a current regulating state and an open state such that as the voltage of the voltage supply increases, LED segments are switched on and lit to form a higher forward voltage LED string, and as the voltage of the voltage supply decreases, segments are switched off and removed from the LED string starting with the most recently lit segment, wherein the voltage supply includes a triac dimmer having an RC timing circuit, and the LED array switching apparatus further comprises:

a bleeder circuit coupled to the voltage supply and the constant current sources, the bleeder circuit including a bypass resistor, the bleeder circuit being operable to connect the bypass resistor across the input voltage, to allow sufficient charging current to be supplied to the RC timing circuit, when the rectified input voltage is low enough to indicate that the triac is off, and to disconnect the bypass resistor when the input voltage is high enough to indicate that the triac is on.

2. The LED array switching apparatus according to claim 1, further comprising:

a toggle switcher that has an output that toggles between a first output and a second output complementary to the first output;

a first switch coupled to the first output of the toggle switcher;

a second switch coupled to the second output of the toggle switcher and to the plurality of constant current sources; and a plurality of second constant current sources (GT1) to (GTn) coupled to outputs of LED segments (Dn) to (D1), respectively, and to the first switch, wherein when the first output of the toggle switcher is active, the first switch becomes closed and the second constant current sources are disabled and the constant current sources are active, and when the second output of the toggle switcher is active, the second switch is closed and the constant current sources are disabled and the second constant current sources are active.

3. The LED array switching apparatus according to claim 2, wherein when the second output of the toggle switcher is active, the LED segments are switched on and lit in an opposite order from when the first output of the toggle switcher is active.

4. The LED array switching apparatus according to claim 3, wherein the toggle switcher toggles at a frequency of greater than 20 Hz.

5. The LED array switching apparatus according to claim 1, wherein successive ones of the plurality of constant current sources are switched on and off such that only one of the plurality of constant current sources supplies current to the LED segments forming the LED string at any given time.

6. The LED array switching apparatus according to claim 1, wherein each of the plurality of constant current sources includes circuitry that detects a current flowing through the LED string and enables or disables that constant current source based on the detected current.

7. The LED array switching apparatus according to claim 1, wherein the voltage supplied by the voltage supply is a rectified AC voltage signal.

8. A method of driving an LED array that includes a plurality of LED segments (D1) to (Dn) connected in series, each LED segment having a forward voltage, a voltage supply coupled to the plurality of LED segments, and a plurality of constant current sources (G1) to (Gn), coupled to outputs of LED segments (D1) to (Dn), respectively, wherein the voltage supply includes a triac dimmer having an RC timing circuit, and the LED array further comprises:

a bleeder circuit coupled to the voltage supply and the constant current sources, the bleeder circuit including a bypass resistor, the bleeder circuit being operable to connect the bypass resistor across the input voltage, to allow sufficient charging current to be supplied to the RC timing circuit, when the rectified input voltage is low enough to indicate that the triac is off, and to disconnect the bypass resistor when the input voltage is high enough to indicate that the triac is on, the method comprising:

(a) when the voltage of the voltage supply is increasing:

switching on successive ones of the constant current sources, so as to form a higher forward voltage LED string of the LED segments and disabling others of the constant current sources, such that only one of the plurality of constant current sources supplies current to the LED segments forming the LED string at any given time; and (b) when the voltage of the voltage supply is decreasing, switching on successive ones of the constant current sources, in reverse order from the switching on performed in step (a), so as to form a lower forward voltage string of the LED segments and disabling others of the constant current sources, such that only one of the plurality of constant current sources supplies current to the LED segments forming the LED string at any given time.

9. The method of driving an LED array according to claim 8, wherein when the voltage supply is increasing, the LED segments are successively added to the string of the LED segments.

10. The method of driving an LED array according to claim 8, wherein when the voltage supply is decreasing, the LED segments are successively removed from the string of the LED segments.

11. The method of driving an LED array according to claim 8, wherein circuitry in the plurality of constant current sources senses current flowing through LED segments and the switching on and disabling of respective ones of the constant current sources is performed on the basis of the sensed current.

* * * * *